US008042442B2

(12) United States Patent
Kirschner et al.

(10) Patent No.: US 8,042,442 B2
(45) Date of Patent: Oct. 25, 2011

(54) CUTTING TOOL

(75) Inventors: Robert Kirschner, Olching (DE); Roland Hemper, Tutzing (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 1394 days.

(21) Appl. No.: 11/046,790

(22) Filed: Feb. 1, 2005

(65) Prior Publication Data

US 2005/0188802 A1 Sep. 1, 2005

Related U.S. Application Data

(63) Continuation of application No. PCT/EP2003/008564, filed on Aug. 1, 2003.

(30) Foreign Application Priority Data

Aug. 1, 2002 (DE) ..... 102 35 185

(51) Int. Cl.
*B26D 1/06* (2006.01)

(52) U.S. Cl. ..... 83/128; 83/684; 83/696

(58) Field of Classification Search ..... 83/128, 83/111–124, 132, 138, 139, 142, 146, 684, 83/686, 911; 76/107.1, 107.8
See application file for complete search history.

(56) References Cited

U.S. PATENT DOCUMENTS

| | | | | | |
|---|---|---|---|---|---|
| 771,669 | A | * | 10/1904 | Schneegass | 427/293 |
| 2,191,709 | A | * | 2/1940 | Dedrick | 83/652 |
| 2,850,096 | A | * | 9/1958 | Berlin et al. | 83/641 |
| 3,048,069 | A | * | 8/1962 | Berlin et al. | 83/123 |
| 3,137,188 | A | | 6/1964 | Domka | |
| 3,181,405 | A | * | 5/1965 | Coy | 83/123 |
| 3,205,750 | A | * | 9/1965 | Strange | 83/660 |
| 3,396,620 | A | * | 8/1968 | Raphael et al. | 83/686 |
| 3,411,208 | A | * | 11/1968 | Malm | 30/350 |
| 3,492,903 | A | * | 2/1970 | Malm | 83/652 |
| 3,827,322 | A | * | 8/1974 | Saunders et al. | 83/128 |
| 3,847,036 | A | | 11/1974 | Miller | |
| 4,306,476 | A | * | 12/1981 | Saunders et al. | 83/117 |
| 4,444,075 | A | * | 4/1984 | Mulry | 83/128 |
| 4,499,802 | A | * | 2/1985 | Simpson | 83/117 |

(Continued)

FOREIGN PATENT DOCUMENTS

CH 493 313 1/1969

(Continued)

OTHER PUBLICATIONS

International Search Report, filed Aug. 1, 2003.

(Continued)

*Primary Examiner* — Phong H Nguyen
(74) *Attorney, Agent, or Firm* — Crowell & Moring LLP

(57) ABSTRACT

A cutting tool, particularly for steel sheet billets, having a cutting blade fastened to a blade holder and a pressure cushion which is arranged on sides of the blade holder and, when the cutting blade penetrates into the material to be punched, is pressed onto the latter in the area of the useful punched part. During the passage of the cutting blade, a high-quality edge of the useful punched part is largely kept free of an interfering burr and elevation formation by the pressure cushion material being displaced radially outward during the punching stroke, such that the cutting blade is acted upon by pressure in the lateral direction under an increasing elastic deflection of the cutting blade edge.

16 Claims, 1 Drawing Sheet

U.S. PATENT DOCUMENTS

| | | | | | |
|---|---|---|---|---|---|
| 4,607,553 | A | | 8/1986 | Hartzell | |
| 4,790,223 | A | | 12/1988 | Busch | |
| 5,111,725 | A | * | 5/1992 | Simpson et al. | 83/117 |
| 5,676,032 | A | * | 10/1997 | Johnson | 83/697 |
| 6,408,729 | B1 | * | 6/2002 | Johnson | 83/697 |
| 6,779,426 | B1 | * | 8/2004 | Holliday | 83/13 |
| 2003/0000354 | A1 | * | 1/2003 | Workman et al. | 83/13 |

FOREIGN PATENT DOCUMENTS

| | | | |
|---|---|---|---|
| DE | 1 782 213 | | 2/1959 |
| DE | 36 30 287 | C1 | 9/1986 |
| DE | 101 40 496 | A1 | 8/2001 |
| EP | 0 331 605 | A2 | 9/1989 |
| EP | 03278466 | | 4/1993 |
| FR | 1170174 | | 9/1956 |
| JP | 05 092398 | A | 4/1993 |

OTHER PUBLICATIONS

German Search Report, filed Mar. 12, 2003.

* cited by examiner

CUTTING TOOL

This application is a continuation of International Patent Application No. PCT/EP2003/008564, filed Aug. 1, 2003, the disclosure of which is expressly incorporated by reference herein. Priority is claimed based on German Patent Application No. 102 35 185.6, filed Aug. 1, 2002.

BACKGROUND AND SUMMARY OF THE INVENTION

The invention relates to a cutting tool, particularly for steel sheet billets, including a cutting blade and an associated pressure cushion which cooperates with the cutting blade to deflect the blade edge during a punching stroke.

Cutting tools of this type, as they are known, for example, from German Patent Document DE 101 40 496 A1, U.S. Pat. Nos. 3,137,188 A or 4,607,553 A for the punching of sheet-type material, usually plastic material or cardboard, to be punched contain a hollow-cylindrical cutting blade which is sharpened on one side or in a V-shape and which, while not requiring a countertool, requires only a relatively hard supporting surface of the material to be punched, according to U.S. Pat. No. 3,137,188 A, a rubber cushion being arranged in the hollow cross-section of the cutting blade, which rubber cushion operates as a blank holder and ejector for the cut-off part of the punched material. In the case of such cutting tools, the problem arises that, during the passage of the cutting blade, the material to be punched is displaced at both sides of the cutting blade, thus toward the punchings as well as toward the useful punched part, with the result that the useful punched parts have an unclean edge and, particularly in the case of steel sheet billets or other plastically deformable material to be punched, considerable burr formations are exhibited on the bottom side of the useful part and/or toroidal thickenings are exhibited on the top side of the useful part.

It is an object of the invention to further develop a cutting tool of the initially mentioned type such that, during the punching stroke of the cutting blade, the useful punched part receives a high-quality edge which, particularly in the case of steel sheet billets, is largely free of burrs and elevations.

According to the invention, this object is achieved by means of a cutting tool having a cutting blade fastened to a blade holder and a pressure cushion which is arranged on sides of the blade holder and, when the cutting blade penetrates into a material to be punched, is pressed onto the latter in an area of a useful punched part, wherein, by displacing the pressure cushion material during a punching stroke, the cutting blade is acted upon by pressure in a lateral direction under an increasing elastic deflection of a cutting edge of the cutting blade.

According to the invention, as a result of the targeted lateral deflection of the cutting blade edge caused by the pressure cushion, the material to be punched is displaced on one side in the direction of the punchings and an elevation-forming or burr-forming buildup of material on the edge of the useful part is thereby effectively prevented. The result is an extremely precisely cut useful punched part which is largely kept free of interfering projecting material.

In a preferred application of the invention, the cutting blade has a hollow cross-section and the useful punched part is situated on the interior side of the cutting blade edge, and the cutting blade is radially widened in the cutting edge area by the pressure cushion arranged in the cross-sectional interior of the cutting blade. In order to avoid damage to the pressure cushion during the punching stroke of the cutting blade, but simultaneously exercise high lateral deformation forces onto the cutting blade, in the relaxed position, the pressure cushion is arranged with its punched-material-side face preferably essentially flush with the cutting plane of the cutting blade. If the cutting blade is bevelled in the direction of the cutting edge, the bevelling is preferably situated on the side facing away from the pressure cushion, the cutting blade, with a view to an improved cutting quality for fibrous material to be punched, expediently having an additional chamfering on the side facing the pressure cushion in the direction of the cutting edge. For reasons of an improved elasticity behavior, the cutting blade may be provided with at least one parting line extending to the cutting edge.

In a particularly preferred manner, the cutting blade consists of flexible band steel, specifically of a super-high-strength nickel chromium steel of a high elasticity, which has an excellent wear resistance and penetrates even stacked steel sheet billets without any problem and with a high cutting quality. The flexible characteristics of such a band steel are expediently utilized for generating different cutting geometries by means of the cutting tool in a constructively simple manner in connection with a variable fastening of the cutting blade on the blade holder.

Other objects, advantages and novel features of the present invention will become apparent from the following detailed description of the invention when considered in conjunction with the accompanying drawings.

DETAILED DESCRIPTION

Figure 1:
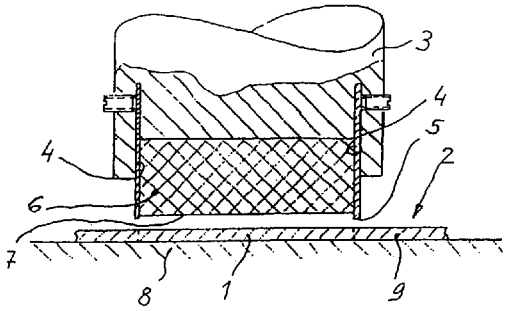
FIG. 1 is a schematic, partially sectional view of a cutting tool constructed according to an embodiment of the invention.

The cutting tool illustrated in the figures is used for cutting a disk-shaped useful punched part 1 out of a steel sheet billet 2 and, for this purpose, contains a band steel cutting blade 4 fastened to a blade holder 3 and having a cutting edge 5, as well as a pressure cushion 6 which fills the hollow cross-section enclosed by the cutting blade 4 and which consists of an elastomer material, such as rubber or plastic, and in the relaxed condition (FIG. 1) is arranged with its useful-part-side face 7 essentially flush with respect to the cutting blade edge 5.

Figure 2A:
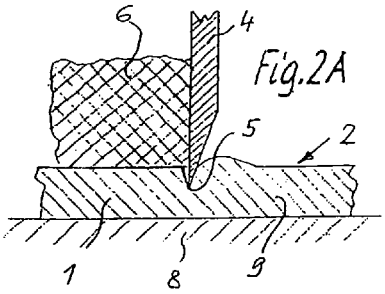
FIGS. 2A and 2B are schematic, enlarged partial representations of the cutting tool embodiment according to FIG. 1 in different cutting phases.
Figure 2B:
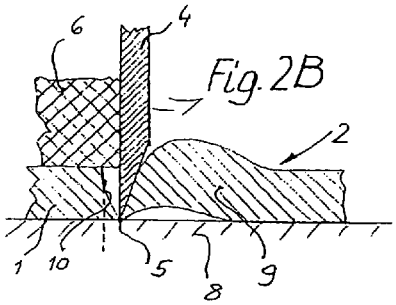

During the punching stroke of the cutting tool, the pressure cushion 6 is pressed approximately simultaneously with the penetration of the cutting blade edge 5 into the steel sheet billet 2 positioned on a firm support 8, for example, made of steel, onto the useful punched part 1 (FIG. 2A). The pressure cushion 6 thus operates as a blankholder for the useful punched part 1. However, in addition, by means of the pressure cushion material which is increasingly displaced during the cutting operation, the cutting blade 4 is acted upon by pressure in the radial direction to such an extent that it elastically expands more an more in the cutting edge area; thus, in the course of the cutting operation, the cutting edge 5 is continuously deflected toward the outside. In this manner, it is ensured that, during the passage of the cutting blade, the excess billet material flows off on one side in the direction of the punching 9, as outlined in FIG. 2B by the arching in the edge area of the punching 9, while the slightly outward-sloped cutting surface 10 of the useful punched part 1 is largely kept free of resulting excess material, and thereby the otherwise normally occurring burr formation on the bottom side of the useful part and the toroidal thickening on the top side of the useful part are effectively prevented.

A super-high-strength nickel chromium steel of a high elasticity and Rockwell hardness, which is available under the HyTens steel trademark and has a wall thickness of approximately 1 mm, was found to be particularly favorable as the band steel material. The HyTens steel, depending on the quality of the material to be punched, can be used either unsharpened or, as illustrated in FIG. 2, can be bevelled on the side facing the punchings in a blade-shaped manner in the direction of the cutting edge 5, and/or, mainly when trimming fibrous material to be punched, can be provided with a slight chamfering (not shown) on the side facing the useful punched part 1.

Figure 3A:
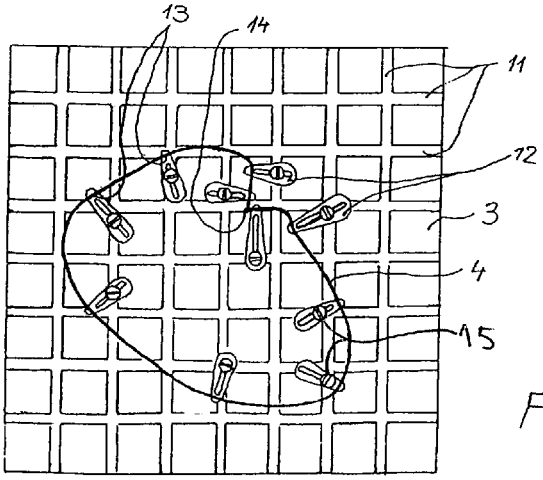
FIGS. 3A and 3B are a schematic bottom view and a schematic cross-section view, respectively, of an embodiment of a blade holder with variably adjustable fastening elements for a band steel cutting blade.
Figure 3B:
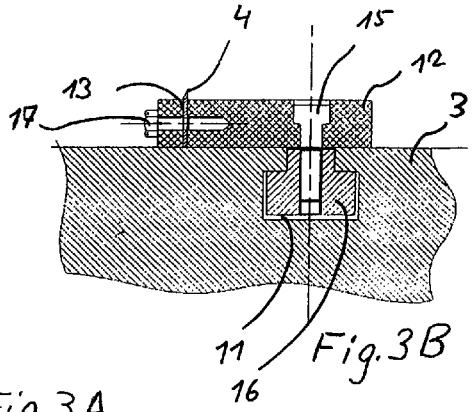

FIGS. 3A and 3B illustrate the possibility of producing different cutting geometries in a simple manner by means of the flexible band steel cutting blade 4. For this purpose, dovetail grooves 11 arranged in a grid-shaped manner on the underside of the blade holder 3, or receiving holes (not shown) for variably adjustable fastening elements 12 are constructed, which fastening elements 12 are equipped with receiving carriages 13 into which the band steel is inserted (shown in FIG. 3B secured by fastener 17) and is thereby brought into the desired cutting geometry. Each variably adjustable fastening element 12 has a fastener 15 which draws a clamping block 16 in dovetail groove 11 against the top of the groove to clamp the fastening element in place. In the area of the band steel ends and/or on sharp kinks of the cutting line, the cutting blade 4 has a parting line 14 which extends continuously to the cutting edge 5 and which facilitates the punching-side elastic deflecting movement of the cutting blade 4 under the effect of the displaced pressure cushion material.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cutting tool for cutting steel sheet billets, comprising:

a blade holder;

a cutting blade fastened to the blade holder; and a pressure cushion which is arranged on a blade side of the blade holder and adjacent to a side of the cutting blade, wherein, the steel sheet billets are supported by a continuous firm support on a side away from the cutting blade in an area opposite the cutting blade such that when the cutting blade is proceeding through the steel sheet billet, steel sheet billet material cannot flow toward the continuous firm support, when the cutting blade penetrates into a material to be punched during a punching stroke, the pressure cushion is pressed on a side of the cushion opposite a side facing the material to be punched in an area of a useful punched part, and the pressure cushion and the cutting blade are arranged such that as the pressure cushion is pressed against the useful punched part, the pressure cushion presses laterally against the cutting blade, such that as the cutting blade proceeds through the material to be punched, the pressure applied by the pressure cushion in a lateral direction causes an increasing elastic deflection of a cutting edge of the cutting blade.

2. Cutting tool according to claim 1, wherein the useful punched part is enclosed by a cutting line of the cutting blade, the pressure cushion is arranged in a cross-sectional interior of the cutting blade, and the latter is elastically expanded by the displaced pressure cushion material in the cutting edge area.

3. Cutting tool according to claim 2, wherein when in a relaxed condition, the pressure cushion is arranged with its punched-material-side face essentially flush with respect to the cutting plane of the cutting blade.

4. Cutting tool according to claim 2, wherein on a side facing away from the pressure cushion, the cutting blade is beveled in the direction of the cutting edge.

5. Cutting tool according to claim 2, wherein the cutting blade has at least one parting line extending to the cutting edge.

6. Cutting tool according to claim 2, wherein the cutting blade consists of flexible band steel.

7. Cutting tool according to claim 6, wherein the band steel consists of a super-high-strength nickel chromium steel of a high elasticity.

8. Cutting tool according to claim 2, wherein the blade holder is provided with variably adjustable cutting blade fastening elements for different cutting geometries.

9. Cutting tool according to claim 2, wherein the pressure cushion consists of an elastomer material.

10. Cutting tool according to claim 1, wherein when in a relaxed condition, the pressure cushion is arranged with its punched-material-side face essentially flush with respect to the cutting plane of the cutting blade.

11. Cutting tool according to claim 1, wherein on a side facing away from the pressure cushion, the cutting blade is beveled in the direction of the cutting edge.

12. Cutting tool according to claim 1, wherein the cutting blade has at least one parting line extending to the cutting edge.

13. Cutting tool according to claim 1, wherein the cutting blade consists of flexible band steel.

14. Cutting tool according to claim 13, wherein the band steel consists of a super-high-strength nickel chromium steel of a high elasticity.

15. Cutting tool according to claim 1, wherein the blade holder is provided with variably adjustable cutting blade fastening elements for different cutting geometries.

16. Cutting tool according to claim 1, wherein the pressure cushion consists of an elastomer material.

* * * * *